US005175583A

United States Patent [19]

Noh et al.

[11] Patent Number: 5,175,583

[45] Date of Patent: Dec. 29, 1992

[54] DISCHARGE TRAY FOR AN ELECTRONIC PHOTO PROCESSOR

[75] Inventors: Myung H. Noh; Soon T. Jang, both of Seoul, Rep. of Korea

[73] Assignee: Hyundai Electronics Industries Co., Ltd., Kyungki, Rep. of Korea

[21] Appl. No.: 649,897

[22] Filed: Feb. 4, 1991

[30] Foreign Application Priority Data

Feb. 8, 1990 [KR] Rep. of Korea ..... 90-1489
Feb. 21, 1990 [KR] Rep. of Korea ..... 90-2096

[51] Int. Cl.[5] ..... G03G 15/00

[52] U.S. Cl. ..... 355/200; 271/207; 271/213; 271/223; 346/108; 346/145; 355/282; 355/311

[58] Field of Search ..... 355/309, 311, 72, 282, 355/285, 289, 290, 200, 210; 219/216; 346/160, 145, 108; 271/213, 207, 223, 171

[56] References Cited

U.S. PATENT DOCUMENTS 4,748,481 5/1988 Kunihiro ..... 355/200 X
4,786,920 11/1988 Igarashi ..... 346/160 X

FOREIGN PATENT DOCUMENTS 58-139961 8/1983 Japan ..... 271/223
58-144045 8/1983 Japan ..... 271/213
61-169446 7/1986 Japan ..... 271/213
61-203047 9/1986 Japan ..... 271/223
61-217465 9/1986 Japan ..... 271/223
61-238655 10/1986 Japan ..... 271/223
63-41348 2/1988 Japan ..... 271/213
63-66060 3/1988 Japan ..... 271/207
01-42129 4/1989 Japan ..... 271/171
02-29678 1/1990 Japan ..... 355/285

*Primary Examiner*—A. T. Grimley
*Assistant Examiner*—Shuk Y. Lee
*Attorney, Agent, or Firm*—Merchant, Gould, Smith, Edell, Welter & Schmidt

[57] ABSTRACT

An electronic photo processor having a lower main body provided with a tray inserting slot, and a top cover which can be opened and closed elastically from and to the lower main body, is disclosed. The processor comprises a slidetype opening and closing apparatus for opening and closing the top cover from and to the lower main body. A paper supplying apparatus supplies selectively a plurality of papers and enables the papers to be supplied as being inclined downwards from the top cover. A paper transferring apparatus is formed on the lower main body, for transferring papers supplied from the paper supplying apparatus. An optical apparatus is provided with a scanning unit for scanning a laser beam by converting an electrical signal to the laser beam and a reflecting mirror for reflecting the laser beam. A developing means develops the transfered paper with the laser beam. A fixing apparatus is formed on the lower main body for performing heat treatment of the papers. The fixing apparatus is also capable of being opened and closed, independent of the top cover. A paper discharging means is removably installed in the tray inserting slot for discharging the papers and for selectively adjusting the length and the angle of the paper discharging means, depending upon the size and the quantity of the papers discharged.

19 Claims, 7 Drawing Sheets

FIG.7A
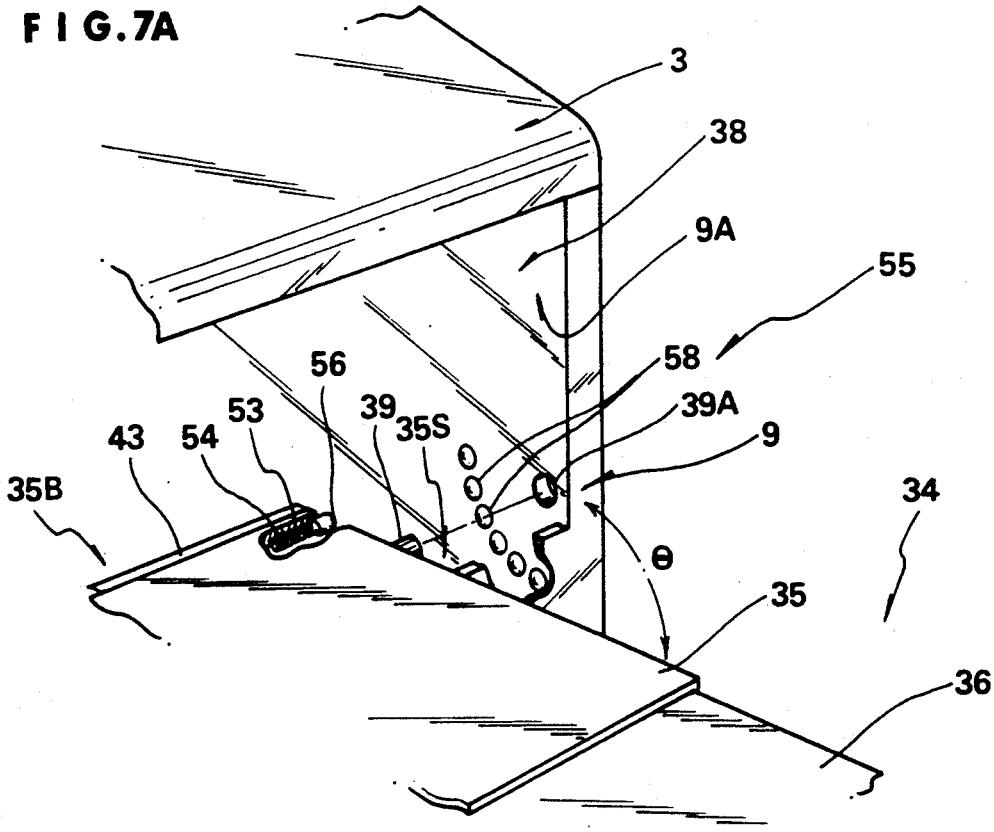
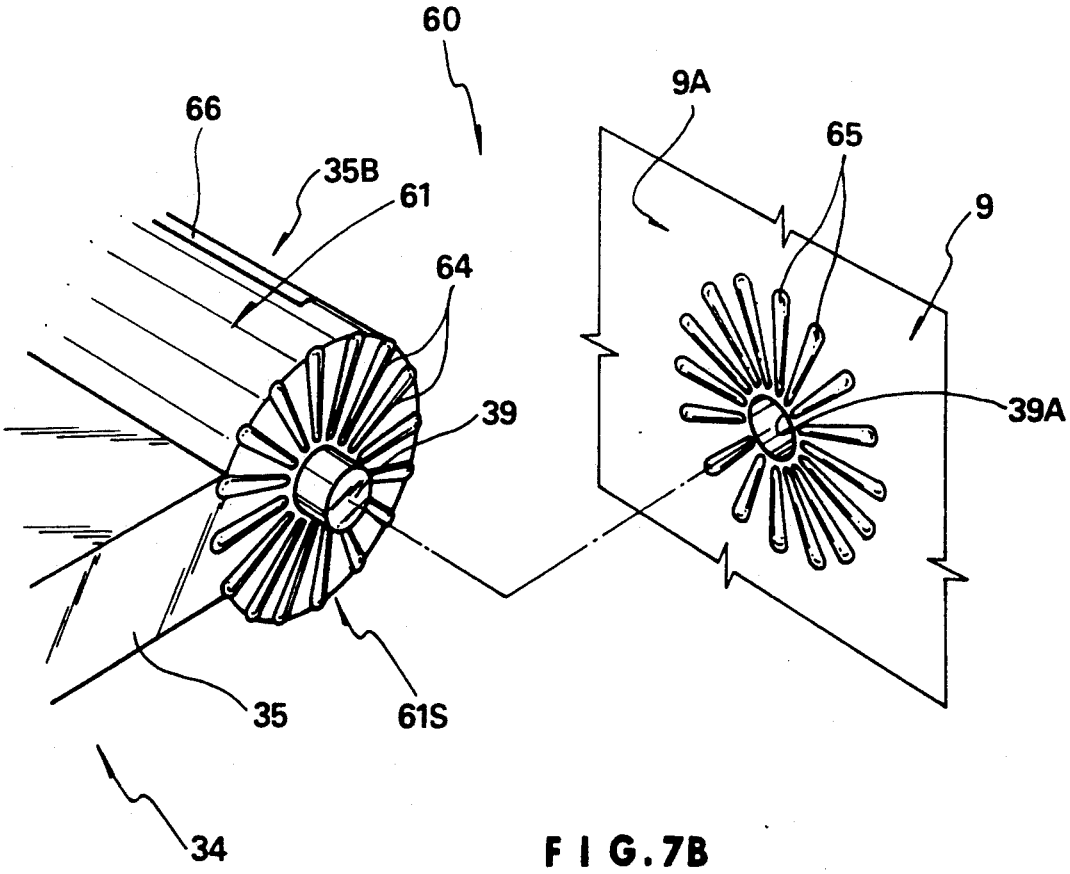
FIG.7B

DISCHARGE TRAY FOR AN ELECTRONIC PHOTO PROCESSOR

BACKGROUND OF INVENTION

1. Field of the Invention

The invention relates to an electronic photo processor in which a paper supplying apparatus, a paper transferring apparatus, an optical apparatus, a developing apparatus, a fixing apparatus and a paper discharging apparatus are constructed independently and, more particularly, to an electronic photo processor which is constructed such that papers of a required size can be freely selected and at the same time the length of the processor can be reduced by providing a paper supplying apparatus on a top cover, in which a plurality of multi-cassettes can be stepwise loaded as being inclined downwards from the side to the lower side, such that it eliminates paper jamming in either the paper transferring apparatus, the developing means or the fixing apparatus, because the top cover and the fixing apparatus can be opened and closed separately, and such that the discharge and the stacking of the papers can be effected satisfactorily by adjusting the angle and the length of a tray unit of the paper discharging apparatus, as required.

2. Description of the Prior Art

Electronic photo processors of the prior art which utilize electronic photo technology are known in many forms. In general, the means for supplying the papers in the prior art processors has a structure in which either one or two cassette-type paper supplying apparatus or a manual-type paper supplying unit protrudes horizontally at one side of the main body of the processors. These processors have problems in that the free selection of a variety of sized papers is not possible and a large installation area is required because the length of the main body of the processor is increased by the length of the protrusion. Further, the papers supplied by the prior art paper supplying apparatus described above are normally transferred utilizing several rollers in order to move the paper through the developing means and the fixing apparatus. When such a means becomes jammed, which occurs frequently at each apparatus of the processor, it is difficult to remove the jam because the top cover of the processor, containing both the developing means and the fixing apparatus, must be lifted so that the paper can be removed, after which strong pressure must be used to lower the cover to the lower main body. Furthermore, it is not possible to eliminate the wear of the parts due to the shock which occurs in lowering the top cover. At the same time, the printing quality becomes poor because the precision of the laser-beam scanner of the optical apparatus and the developing apparatus are repeatedly jarred.

The paper discharging tray unit provided at one side of the paper discharging apparatus is, in general, installed with a certain fixed angle and an axially limited length. When mass printing papers, there occur nuisances in that the printed papers are not discharged and stacked satisfactorily because the tray unit cannot be adjusted in accordance with either the size or the quantity of paper. Furthermore, a structural problem exists whenever papers jam between the fixing apparatus and the paper discharging apparatus inside of the processor. Because the tray unit is generally fixed at the processor to be inclined upwards, the tray unit must be separated from the processor in order to remove the jammed papers. Another problem exists whenever transporting the processor in that the tray unit must be separated from the main body of the processor in order to prevent loss and destruction of the tray unit. Still another problem is that a larger space is required by the processor, because the length of the tray unit projects laterally at the time of installation.

OBJECTS OF THE PRESENT INVENTION

Therefore, an object of the present invention is to provide an electronic photo processor in which free selection of a variety of sized pa is possible and the jammed paper can be easily removed from the processor.

Another object of the present invention is to provide an electronic photo processor in which both the installation angle and the length of the tray unit can be adjusted in accordance with the size and the quantity of the discharged papers so that the papers can be discharged and stacked satisfactorily.

Another object of the present invention is to reduce the installation area of the processor by reducing the length of the main body of the processor.

Still another object of the present invention is to improve the reliability and the repair at the time of the failure of the processor.

The preceding objects should be construed as merely presenting a few of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to both the summary of the invention and the detailed description, below, which describe the preferred embodiment in addition to the scope of the invention defined by the claims considered in conjunction with the accompanying drawings.

SUMMARY OF THE INVENTION

The electronic photo processor of the present invention is defined by the claims with a specific embodiment shown in the attached drawings. For the purpose of summarizing the invention, the invention relates to an electronic photo processor having a lower main body provided with a tray inserting slot on one side of the lower main body, and a top cover which can be opened and closed elastically from and to the lower main body utilizing a tension rotating apparatus on the other side of the lower main body. The processor comprises a slide-type opening and closing apparatus for opening and closing the top cover from and to the lower main body. The apparatus includes a fixing bracket, a lock shaft and a slide-type opening and closing knob which is self-supported elastically by a spring SP. Each of the fixing bracket, lock shaft and slide-type opening and closing knob is installed at the top cover, respectively. The apparatus further includes a double locker arm elastically rotatably engaged to the lock shaft by a tension spring formed on a shaft, and elastically supported by the fixing bracket. The double locker arm is installed at the lower main body, such that, in use, the arm can be disengaged from the lock shaft by slidably pulling the slide-type opening and closing knob to make the top cover open. A paper supplying apparatus supplies selectively a plurality of papers having a variety of sizes, and enables the papers to be supplied as being inclined downwards from the top cover, thereby reducing the installation area of the processor. A paper transferring apparatus is formed on the lower main body, and is provided with a first guide for guiding papers selectively supplied from the paper supplying apparatus. A pair of transferring rollers arranged to be spaced horizontally relative to each other for transferring the papers guided on the first guide, and a pair of register rollers arranged vertically in close contact relative to each other are utilized. An optical apparatus is provided with a scanning unit to scan a laser beam by converting an electrical signal to the laser beam, and a reflecting mirror to reflect the laser beam. A developing means develops the papers transferred from the paper transferring apparatus with the laser beam transmitted from the optical apparatus. A fixing apparatus is formed on the lower main body for performing heat treatment of the papers developed by the developing means. The fixing apparatus is also capable of being opened and closed, independent of the top cover. A paper discharging means is removably installed in the tray inserting slot of the lower main body for discharging the papers and for selectively adjusting the length and the angle of the paper discharging means, depending upon the size and the quantity of the papers discharged.

Preferably, the paper supplying apparatus of the electronic photo processor according to the invention comprises multi-cassettes for selectively containing the papers having a variety of sizes. Each of the multi-cassettes includes openings to selectively discharge the papers contained therein. Cassette receiving slots are formed to be inclined downwards on the top cover for loading the multi-cassettes inclined downwards. Pick-up rollers are also installed in close contact with the openings of the multi-cassettes so as to extract the papers. Frictional plates are operatively installed in close contact with the pick-up rollers for producing the frictional forces to extract the papers.

Preferably, the developing means of the electronic photo processor according to the invention comprises a charging apparatus charged by the electrical signals. A photosensitive drum forms an electrostatic latent image by being charged by the charging apparatus. A developing apparatus develops, with toner, the latent image formed by the photosensitive drum and converts it to a visible image. An image transferring apparatus transfers the visible image bearing on the photosensitive drum to the papers transferred by the paper transferring apparatus. A separating apparatus separates the papers from the photosensitive drum. A cleaning apparatus removes the toner remaining from transferring the visible image on the photosensitive drum to the papers. A latent image removing lamp removes the electrostatic latent image of the photosensitive drum by a laser beam.

Preferably, the fixing apparatus of the electronic photo processor according to the invention comprises a housing which includes a receiving opening for receiving the papers transferred through the first guide of the paper transferring apparatus. The housing further includes an upper end positioned at the side of the receiving opening and a lower end positioned at the opposite side of the receiving opening. A heating roller and pressurizing roller are provided for heat-treatment of the papers transferred through the receiving opening. The rollers are also installed in the housing. A second guide is provided for guiding the papers through the heat-treatment in the heating roller and the pressurizing roller. A first cover is rotatably installed by a first hinge at the upper end of the receiving opening of the housing. A second cover is rotatably installed by a second hinge at the first cover, with the second cover having a handle at its one end. A third cover is rotatably installed by a third hinge at the lower end positioned at the opposite side to the receiving opening of the housing. The third cover further includes a discharging opening for discharging the papers, a pair of paper discharging rollers for discharging the papers toward the discharging opening, and a connecting piece which detachably connects with the handle of the second cover, such that, in use, the fixing apparatus can be completely or partially opened by disengaging the handle of the second cover from the connecting piece of the third cover.

Preferably, the paper discharging means of the electronic photo processor according to the invention comprises a tray unit means the length of which can be adjusted depending upon the size of the papers discharged and an angle adjusting means which is provided at the tray inserting slot of the lower main body having an inner wall so as to adjust the angle of the tray unit means. A tray unit of the tray unit means comprises a first hollow panel having two sides, two inner sides, a rear end, a front end and a top portion. The first panel further includes a pair of stops formed at both of the inner sides of the front end, a pair of shafts formed at both of the sides of the rear end and a drawing hole formed in the middle of the top portion. A second hollow panel includes two sides, two inner sides, a rear end and a front end. The second panel further includes a pair of stops formed at both of the inner sides of the front end and protrusions formed at both of the sides of a rear end so as to interact with the stops of the first panel, such that, in use, the second panel is inserted by sliding it into the first panel through the rear end of the first panel. A third panel includes two sides and a rear end. The third panel further includes protrusions formed at both of the sides of the rear end so as to interact with the stops of the second panel, such that, in use, the third panel is inserted by sliding it into the second panel through the rear end of the second panel. A panel securing bracket is provided at the rear end of the first panel to prevent the second and third panel, inserted into the first panel, from escaping therefrom.

Preferably, one embodiment of the angle adjusting apparatus of the angle adjusting means comprises a pair of shaft supporting holes formed at the inner wall of the tray inserting slot of the lower main body to rotatably support a pair of the shafts formed at both of the sides of the rear end of the first panel. A pair of arcuate brackets are also formed at both of the sides of the rear end of the first panel of the tray unit. Each of the arcuate brackets includes concavo-convex ends, respectively. A pair of band springs are installed on the lower main body utilizing a plurality of bolts. Each of the band springs includes concavo-convex portions which elastically interlock with the concavo-convex ends to thereby adjust the angle of the tray unit.

Preferably, another embodiment of the angle adjusting apparatus of the angle adjusting means comprises a pair of shaft supporting holes formed at the inner wall of the tray inserting slot of the lower main body to rotatably support a pair of the shafts formed at both of the sides of the rear end of the first panel. A pair of holes also are formed at both of the sides of the rear end of the first panel of the tray unit. Each of the holes further includes a spring contained therein and a ball elastically supported by the spring. A plurality of hemisphere recesses are formed at the inner wall of the receiving hole of the lower main body at a position corresponding to a track for rotation of the balls at the time of rotation of the tray unit about the shafts, such that, in use, the ball which is elastically supported by the springs contained in the elastic holes is frictionally interlocked with the plurality of hemisphere recesses to thereby adjust the angle of the tray unit.

Preferably, still another embodiment of the angle adjusting apparatus of the angle adjusting means comprises a pair of shaft supporting holes formed at the inner wall of the tray inserting slot of the lower main body to rotatably support a pair of the shafts formed at both of the sides of the rear end of the first panel. A cylindrical adjusting member is also formed at the rear end of the first panel of the tray unit. The cylindrical adjusting member further includes two sides with each side having a center at which a shaft is formed, respectively. A plurality of angle adjusting protrusions are radially formed on both of the sides having the shaft. A plurality of friction protrusions are formed radially on the inner wall of the lower main body at a position corresponding to the plurality of angle adjusting protrusions, such that, in use, the plurality of angle adjusting protrusions are frictionally interlocked with the plurality of friction protrusions to thereby adjust the angle of the tray unit.

Preferably, still another embodiment of the angle adjusting apparatus of the angle adjusting means comprises a pair of shaft supporting holes formed on the inner wall of the tray inserting slot of the lower main body to rotatably support a pair of the shafts formed at both of the sides of the rear end of the first panel. A cylindrical adjusting member is also formed on the rear end of the first panel of the tray unit. The cylindrical adjusting member further includes two side having a high frictional coefficient, the center of each formed with the shafts. A frictional member of a high frictional coefficient is inserted between both of the sides and the inner wall of the tray inserting slot of the lower main body, such that, in use, the angle of the tray unit can be adjusted by producing a frictional force between both of the sides of the cylindrical adjusting member and the frictional member.

Preferably, an another embodiment of the tray unit of the tray unit means according to the invention comprises a first panel having two sides, a rear end, a front end and a top portion. The first panel further includes a shaft formed on each side of the rear end. A second panel includes a front end and a top portion. The second panel is further installed to be folded to the top portion of the first panel by utilizing a first hinge formed at the front end of the first panel. A third panel is installed to be folded to the top portion of the second panel utilizing a second hinge formed at the front end of the second panel, such that, in use, the second and third panels can be selectively folded.

The more pertinent and important features of the present invention have been outlined above in order that the detailed description of the invention which follows will be better understood and that the present contribution to the art can be fully appreciated. Additional features of the invention described hereinafter form the subject of the claims of the invention. Those skilled in the art can appreciate that the conception and the specific embodiment disclosed herein may be readily utilized as a basis for modifying or designing other structures for carrying out the same purposes of the present invention. Further, those skilled in the art can realize that such equivalent constructions do not depart from the spirit and scope of the invention as set forth in the claims.

BRIEF DESCRIPTION OF THE DRAWINGS

For fuller understanding of the nature and objects of the invention, reference should be made to the following detailed description taken in conjunction with the accompanying drawings in which.

Similar reference characters refer to similar parts throughout the several views of the drawings.

DETAILED DESCRIPTION OF THE INVENTION

Figure 1:
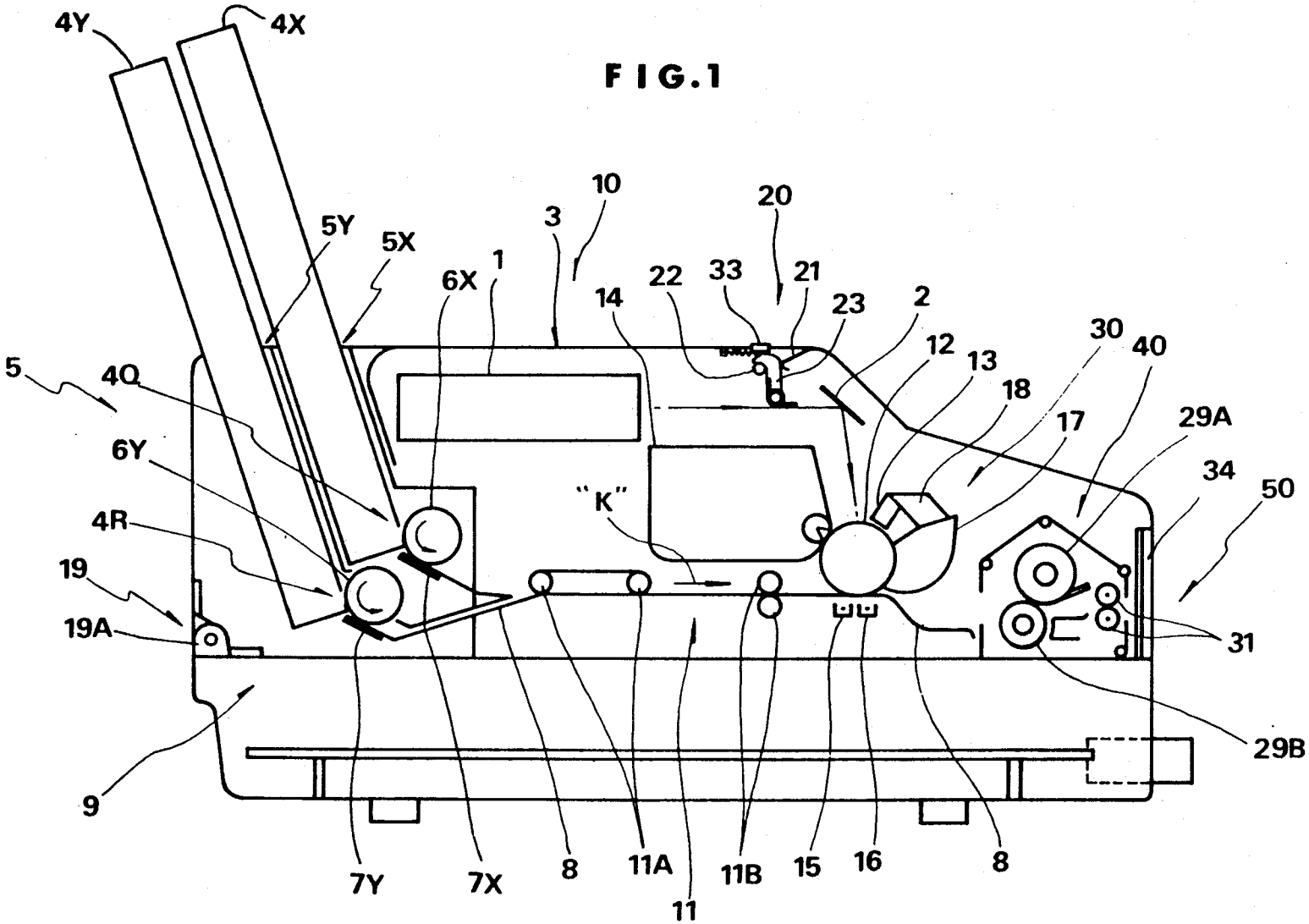
FIG. 1 illustrates a schematic structure of an electronic photo processor according to the present invention.

Turning now to FIG. 1, an electronic photo processor of the present invention is shown in a schematic structural view.

A top cover 3 is provided with a scanning unit 1 for scanning by converting the electrical signal, received from an operating panel (not shown), to a laser-beam and with an optical apparatus 10 composed of a reflecting mirror 2 for reflecting the scanned signal.

On one side of the top cover, a paper supplying apparatus 5 is constructed which enables multi-cassettes 4X and 4Y containing a variety of sized papers to be replaced stepwise through a cassette receiving slots 5X and 5Y as being inclined downwards from the upper side to the lower side. The paper supplying apparatus 5 includes pick-up rollers 6X and 6Y, frictional plates 7X and 7Y and a first guide 8. Constructed at the lower side of the multi-cassettes 4X and 4Y are openings 4Q and 4R which are opened so that the papers can interlock with the pick-up roller 6 in order to be supplied.

The top cover 3 is seated on a lower main body 9. The lower main body 9 is provided with a pair of transferring rollers 11A that are horizontally spaced relative to each other, as well as a pair of register rollers 11B that are vertically arranged in close contact with each other. The lower main body 9 is also provided with a paper transferring apparatus 11 including a first guide 8. A developing means 30 is constructed on the paper transferring apparatus 11, at the side of the proceeding direction (Arrow "K"). The developing means 30 has a known photosensitive drum 12, a known charging apparatus 13, a known developing apparatus 14, a known image transferring apparatus 15, a known separating apparatus 16, a known cleaning apparatus 17 and a known latent image removing lamp 18. The developing means 30 is generally installed on the lower main body 9 in the manner of well known in the art. The lower main body 9 and the top cover 3 are provided with a plurality of tension rotating apparatuses 19 composed of a plurality of spring hinges 19A on one side, so that the top cover 3 is elastically rotated about the lower main body 9 utilizing the tension rotating apparatus 19 as its axis.

Figure 2B:
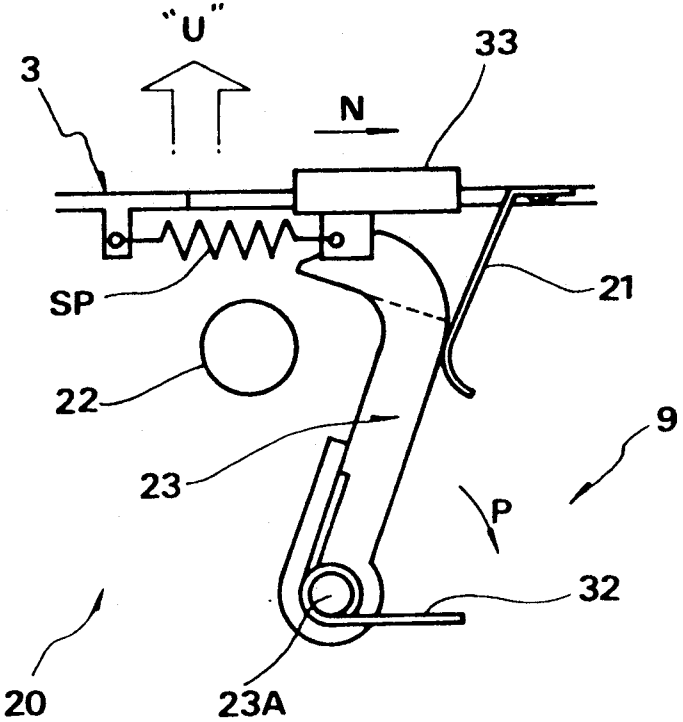
FIGS. 2A and 2B illustrate the operation condition of the side-type opening and closing apparatus of the top cover according to the present invention.
Figure 2A:
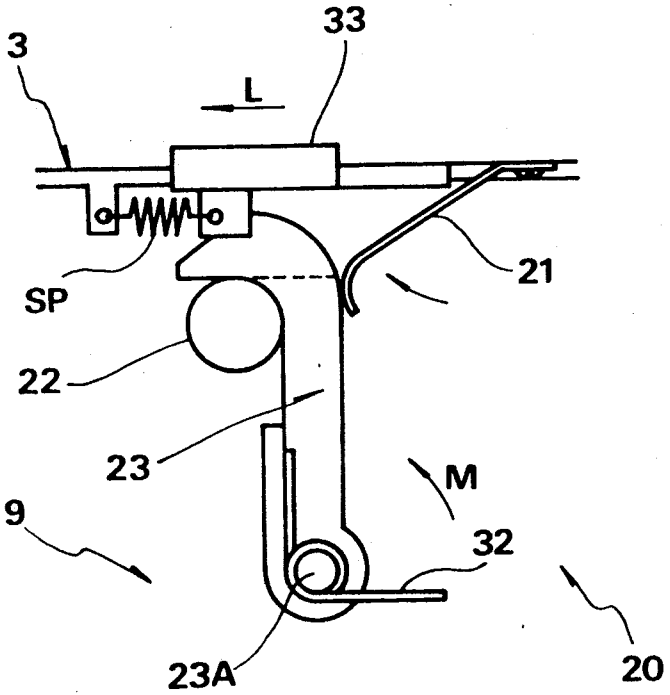

On the middle top part of the top cover 3 of FIG. 1 is provided a slide-type opening and closing apparatus 20 as shown in FIG. 2A and 2B. The slide-type opening and closing apparatus 20 is constructed in such a way that, by installing a slide-type opening and closing knob 33 which is elastically self-supported by a spring SP, a fixing bracket 21 and a lock shaft 22 on the top cover 3, the lock shaft 22 can be firmly engaged with or disengaged from a double locker arm 23 which is installed elastically and rotatively along a shaft 23A on the lower main body 9 by a tension spring 32. That is, if the slide-type opening and closing knob 33 which is self-supported by a spring SP in the direction of the arrow "L" as shown in FIG. 2A is pulled in the direction of the arrow "N" shown in FIG. 2B, the double locker arm 23 which is supported by the fixing bracket 21 and the tension spring 32 in the direction of the arrow "M" rotates in the direction of the arrow "P" about the shaft 23A so that the lock shaft 22 and the double locker arm 23 disengage from each other. At the same time, the top cover 3 opens elastically in the direction of the arrow "U" from the lower main body 9 with the spring hinge 19A as its axis of rotation.

Figure 3B:
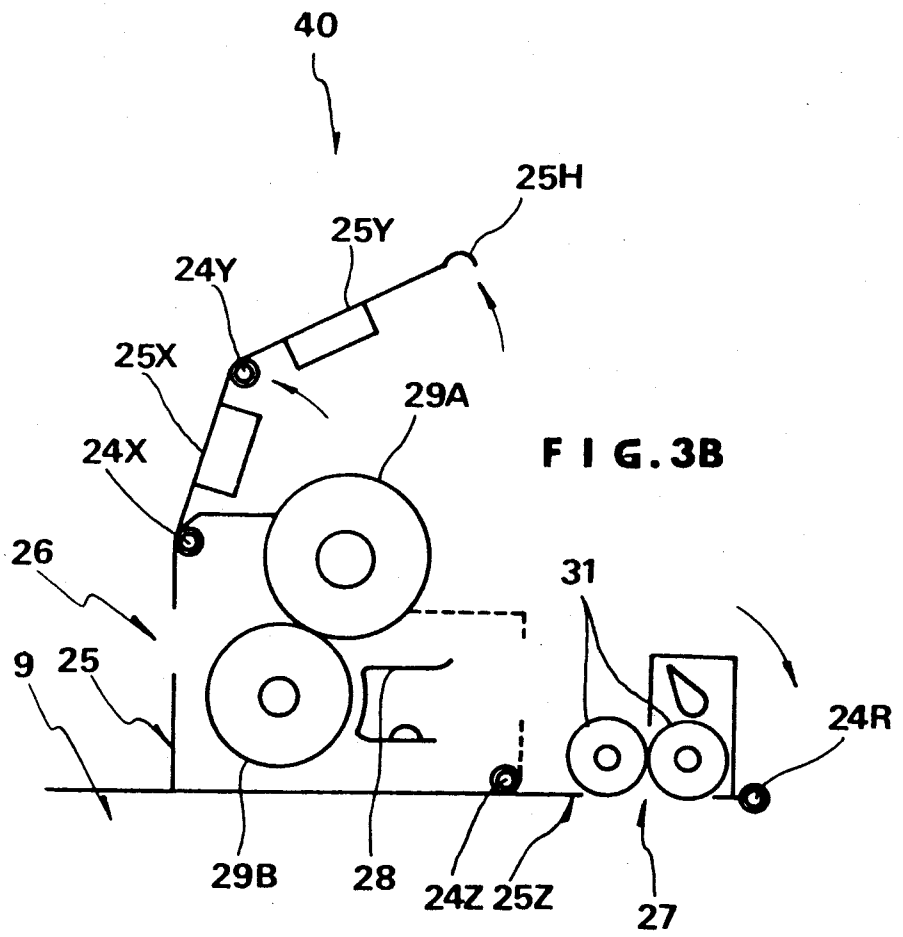
FIGS. 3A and 3B illustrate the operation condition of the fixing apparatus according to the present invention.
Figure 3A:
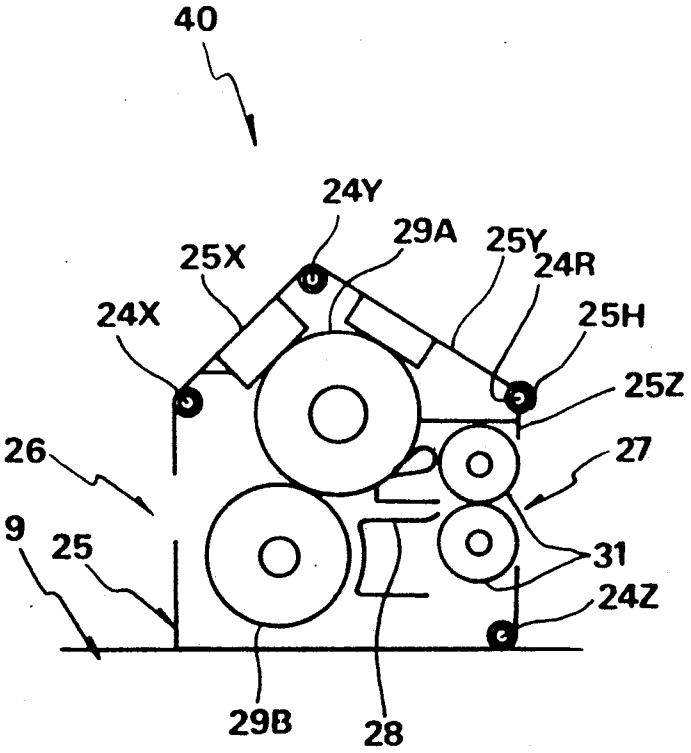

FIGS. 3A and s a fixing apparatus 40 which is constructed on the proceeding direction side of the developing means 30 on the lower main body 9. This construction permits the fixing apparatus 40 to be opened on one of its sides, independently of the top cover 3.

The fixing apparatus 40 is located on the lower main body 9 as shown in FIG. 3A. The fixing apparatus 40 has a housing 25 with a receiving opening 26 which receives the paper transferred through the first guide 8 of the paper transferring apparatus 11. The housing 25 is provided with a heating roller 29A for heat-treating the paper transferred from the receiving opening 26 as well as a pressurizing roller 29B which operates in engagement with the heating roller 29A. The paper heat-treated by the heating roller 29A and the pressurizing roller 29B is then discharged through the discharging opening 27 by a pair of paper discharging rollers 31 via a second guide 28.

The fixing apparatus 40 has a first, second, third cover 25X, 25Y and 25Z, each of which is capable of opening and closing. More specifically, at the upper end of the receiving opening 26 of the housing 25 fixed on the lower main body 9, a first hinge 24X is installed which engages with one end of the first cover 25X. At the other end of the first cover 25X, a second hinge 24Y is installed which engages with one end of the second cover 25Y. Thus, the first cover 25X is rotatable by the first hinge 24X about the housing 25, while the second cover 25Y is rotated by the second hinge 24Y about the first cover 25X as well as the housing 25. The third cover 25Z is installed so that it is rotatable about the housing 25 by having one of its ends engaged to the bottom of the housing 25 at its one end by a third hinge 24Z. The other end of the third cover 25Z is provided with a connecting piece 24R which interlocks with a handle 25H that is constructed on the end of the second cover 25Y. Further, discharge opening 27 is formed at the middle part of the third cover 25Z. A pair of paper discharging rollers 31 is installed toward the discharging opening.

Therefore, the heating roller 29A and the pressurizing roller 29B can be either partly or completely exposed to the outside by the first cover 25X, the second cover 25Y or the third cover 25Z, as shown in FIG. 3B.

The operation and the effect of FIG. 1, FIG. 2A, FIG. 2B, FIG. 3A and FIG. 3B described above will be described below.

A laser-beam scanned from the scanning unit 1 in the top cover 3 is reflected at the reflecting mirror 2 and transmitted to the developing means 30. That is, the developing means 30 forms an electrostatic latent image on the photosensitive drum 12 charged by the charging apparatus. Thereafter, this latent image is developed by toner at the developing apparatus 14 and changed to a visible image. At this time, the papers are discharged one by one satisfactorily and exactly through the guide 8 from one of the multi-cassettes 4X or 4Y selected by the electronic control by either pick-up roller 6X or 6Y and either the friction plate 7X or 7Y. This can be accomplished because the multi-cassettes 4X or 4Y having a variety of sizes, are installed to be inclined downwards from the top cover 3. Thus, the visible image taken on the photosensitive drum 12 is transferred by the image transferring apparatus 15 to the paper transferred from the paper transferring apparatus 11 composed of the transferring roller 11A, the register roller 11B and the first guide 8.

Thereafter, the paper on the photosensitive drum 14 is separated from the drum 14 by the separating apparatus 16. It is then guided again by the first guide 8 to be moved to the fixing apparatus 40. Then the toner which is transferred to the paper is fixed on the paper at the fixing apparatus 40 by the heat of the heating roller 29A and the pressure of the pressurizing roller 29B. The paper is then discharged by a pair of paper discharging rollers 31 to the paper discharging means 50 which will be described later. At this time, the toner remaining on the paper after the visible image has been transferred at the photosensitive drum 12 is removed by blades in the cleaning apparatus 17 and is then transferred to an exhausted toner collecting can, which is not shown. The latent image is then removed from the photosensitive drum 14 by a light scanned from the latent image removing lamp 18.

While the above procedures are being carried out, if paper should the jam anywhere along the paper transferring apparatus, the developing means or the fixing apparatus, the jammed papers can be simply removed by pushing the slide opening and closing knob 3 of the slide-type opening and closing apparatus 20 installed on the top cover 3, in the direction of the arrow "N" shown in FIG. 2B, releasing the double locker arm 23 installed on the lower main body 9 from the lock shaft 22, and then opening the top cover upward about the spring hinge 19A of the lower main body 9 as the axis, and finally taking out the jammed papers from each part. Thereafter, if the opened top .cover 3 is lowered, the lock shaft 22 of the top cover 3 moves the double locker arm 23 by pushing the front end of the double locker arm 23 installed on the lower main body. At the same time, the double locker arm 23 is returned to its original position by the force of the tension spring 32 which fixes it to the lock shaft 22 as shown in FIG. 2A. At this time, the fixing bracket 21 of the top cover 3 pushes the locked double locker arm 23, and maintains the lower main body and the top cover 3 in their rigid precise engagement, thereby making certain the operation of the processor.

Further, if the paper should happen to jam in the fixing apparatus 40, the jammed paper can be removed by a simple operation since the fixing apparatus 40 can be simply opened by just pulling upwards the handle 25H formed on the third cover 25X of the fixing apparatus 40, without completely opening the top cover 3.

Figure 4:
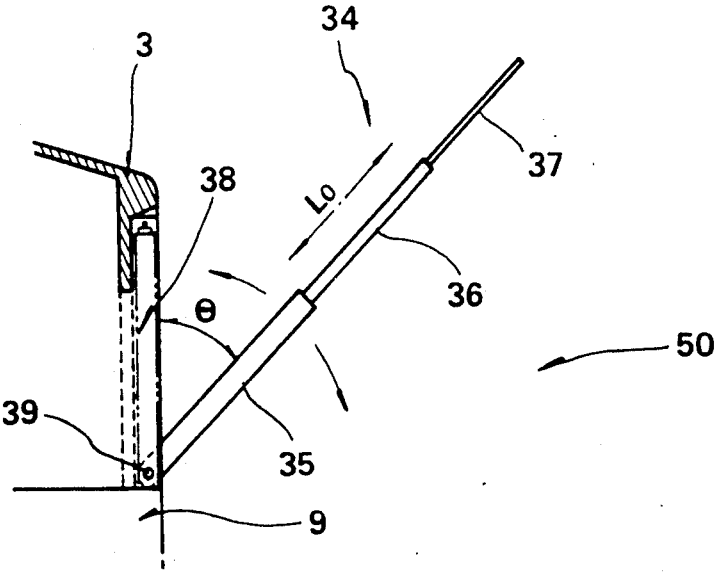
FIG. 4 illustrates of the principle of operating the tray unit according to the present invention.

The papers printed in the above described processor are discharged to the tray unit 34 of the paper discharging means 50 through the pair of paper discharging rollers 31 of the fixing apparatus 40, and then finally stacked on the tray unit 34. FIG. 4 illustrates the principle of the operation of the paper discharging means 50, where the tray unit 34 is constructed such that the papers can be discharged satisfactorily and the length of the tray unit 34 can be adjusted, depending on the amount of papers stacked, by installing the tray unit 34 on the lower main body 9 with the installation angle "$\theta$" being adjustable about the shaft 39, and by sliding a first, second and third panels 35, 36 and 37 so that it engages sequentially as the length Lo of the tray unit 34 is extended. Further, whenever the processor is being either transported or not used, damage to the tray unit 34 can be prevented. That is, the tray unit 34 is protected by folding and inserting it into a tray inserting slot 38 which is formed on the lower main body 9, since the second and the third panel 36 and 37 can be fully inserted into the first panel 35.

Figure 5:
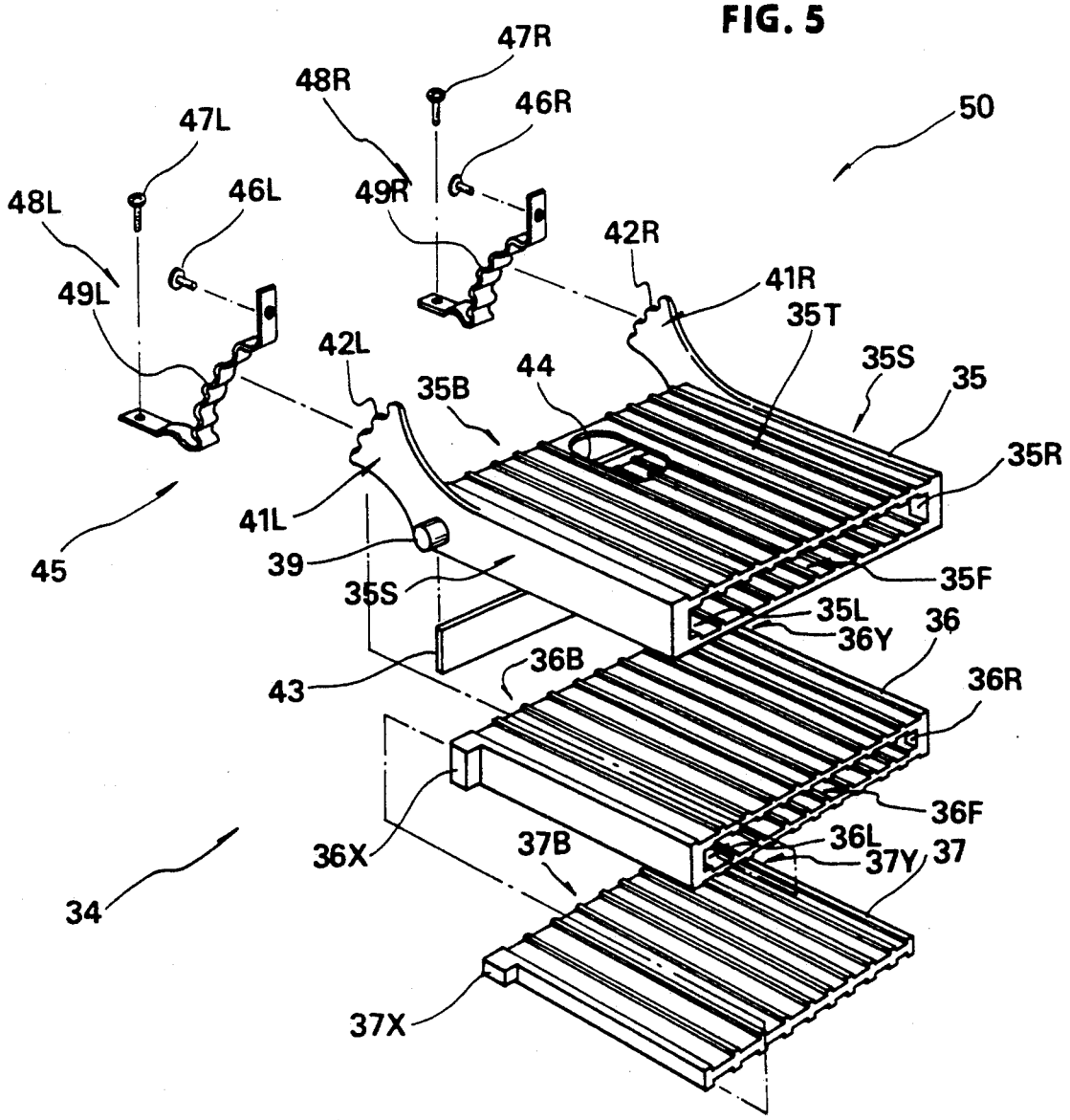
FIG. 5 is an exploded perspective view of an embodiment of the tray unit according to the present invention.
Figure 6A:
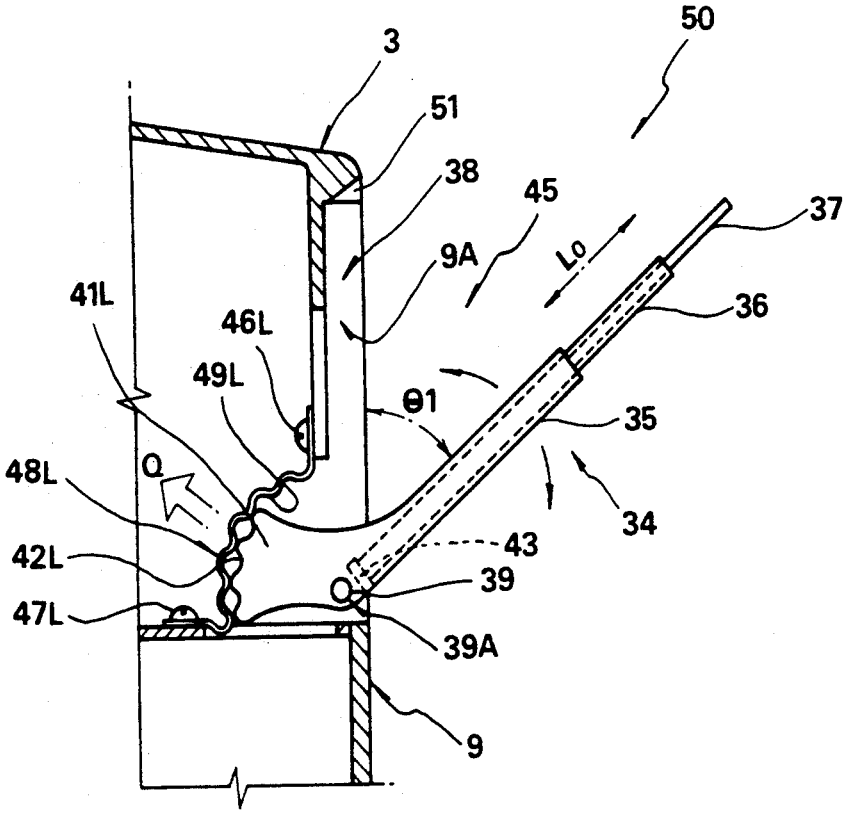
FIGS. 6A and 6B illustrate the operation of the tray unit of FIG. 5; and, FIGS. 7A to 7E show another embodiment of the tray unit according to the present invention.
Figure 6B:
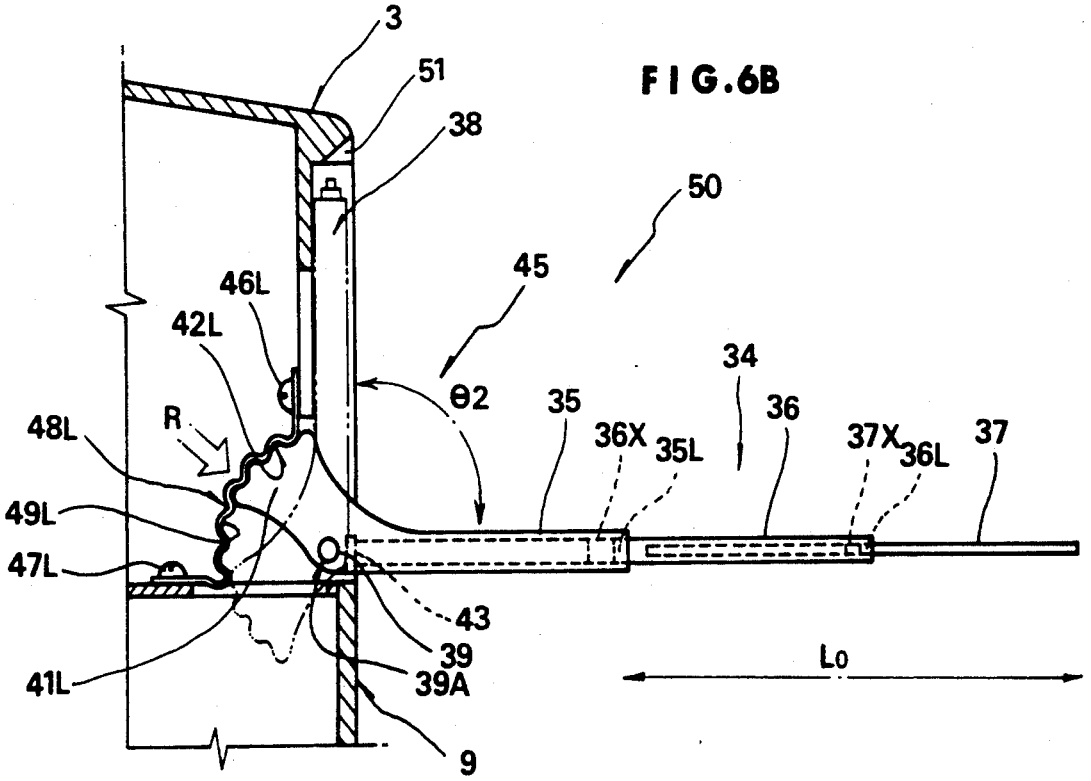

FIG. 5 is an expanded perspective view of the tray unit 34 which is the paper discharging means 50 of the present invention shown in FIG. 4. The tray unit 34 is constructed so that the first, second and third panel 35, 36 and 37 are inserted and engaged sequentially by sliding. Therefore, the third panel 37 is composed of a plate which is provided with protrusions 37X and 37Y at both sides of the rear end 37B. The second panel 36 has a hollow construction in order to receive the third panel 37 through a rear end 36B of the second panel 36. The second panel 36 is also provided with protrusions 36X and 36Y at both sides of the rear end 36B. Stops 36L and 36R are also provided at both inner sides of the front end 36F of the second panel 36. Therefore, the third panel 37 is slid into the rear end 36B of the second panel 36 until the protrusions 37X and 37Y of the third panel 37 are halted by the stops 36L and 36R on the second panel 36, thereby preventing the third panel 37 from escaping. Further, the first panel 35 also has a hollow construction so that it can receive the second panel 36. The first panel 35 is also provided with a shaft 39 at two sides 35S of its rear end 35B. The shaft 39 is supported in a shaft supporting hole 39A formed at an inner wall 9A of the lower main body 9 at a position corresponding to the shaft 39, as shown in FIGS. 6A and 6B, so that the first panel 35 rotates about the shaft 39. The first panel 35 is also provided with stops 35L and 35R at two inner sides of its front end 35F. The second panel 36, containing the third panel 37 inserted within itself, is slid into the rear end 35B of the first panel 35. The protrusions 36X and 36Y, which prevent the escape of the second panel 36, are halted by the stops 35L and 35R of the first panel 35, thereby preventing the second panel 36 from escaping. Further, a drawing hole 44 is formed at the middle of the top portion 35T of the first panel 35 for drawing, when in use, the second panel 36 and the third panel 37 toward the front end 35F. Also, at the rear end 35B of the first panel 35, a bracket 43 is provided to secure the panels and prevent the second and third panels 36, 37, which were inserted in the first panel 35, from escaping. The inner surface and the outer surface of the first, second and third panels 35, 36 and 37 of the tray unit 34 are constructed having a longitudinal concavo-convex configuration which minimizes friction between the surfaces which slide over one another to extend or retract, and also minimizes the friction coefficient between each of the first, second and third panels 35, 36 and 37 and the papers being discharged.

Angle adjusting apparatuses 45 are provided on both of the sides of the rear end 35B of the first panel 35 of the tray unit 34. That is, at both of the sides 35S of the rear end 35B are integrally provided a pair of arcuate brackets 41L and 41R having concavo-convex ends 42L and 42R, respectively. Band springs 48L and 48R, having concavo-convex portions 49L and 49R which interlock with the concavo-convex ends 42L and 42R of the arcuate brackets 41L and 41R, are installed on the lower main body 9 using a plurality of bolts 46L and 46R, and 47L and 47R, as shown in FIGS. 6A and 6B.

FIGS. 6A and 6B illustrate a side view of the operation of the tray unit of the paper discharging means of the present invention shown in FIG. 5. Once the first, second and third panels 35, 36 and 37 of the tray unit 34 of the paper discharging means 50 have been slid into their inserted position and engaged, the tray unit 34 is rotatively installed by the shaft 39 which is supported by the shaft supporting hole 39A formed at the inner wall 9A of the tray inserting slot 38 of the lower main body 9. The paper discharging means 50 is constructed in such a way that the tray unit 34 is adjustable in its angle up and down by the angle adjusting apparatus 45. That is, the arcuate bracket 41L of the tray unit 34 is installed so that it can elastically interlock with the band spring 48L that is installed on the lower main body 9 by a plurality of bolts 46L and 47L, so that the concavo-convex end 42L of the arcuate bracket 41L is elastically engaged with concavo-convex portion 49L of the band spring 48L. Therefore, when a force is applied to the tray unit 34 (for example, downwards to adjust the tray unit to an arbitrary angle "$\theta 1$" desired by the user), the band spring 48L which elastically supports the arcuate bracket 41L is extended by the force and is be pushed in the direction of the arrow "Q". At the same time, the close contact between the concavo-convex portion 49L of the band spring 48L and the concavo-convex end 42L of the arcuate bracket 41L is almost released. Therefore, using the above described principle of operation, the band spring 48L can be lowered by the self-restoring force in the direction of the arrow "R" as shown in FIG. 6B, using very little force. As a result, the tray unit 34 can be adjusted to the angle "$\theta 2$".

Further, FIG. 6B illustrates that the length Lo of the tray unit 34 can be selectively increased or reduced, depending on the size of the discharged papers. That is, as illustrated in detail in FIG. 5, the second and third panels 36 and 37, which were inserted by sliding sequentially into the first panel, extend in the longitudinal direction, as shown. At this time, as illustrated in FIG. 5, the second and the third panels 36 and 37 are kept from moving in the longitudinal direction by the panel securing bracket 43 provided at the rear end 35B of the first panel 35, the stops 35L and 36L formed on the first and the second panel 35 and 36 and the escape preventing protrusions 36X and 37X formed on the second and the third panels 36 and 37.

Alternatively, when the processor is being either transported or not used, the tray unit 34 having the first, second and third panel 35, 36 and 37 is folded and inserted into the tray inserting slot 38. That is, formed at one side of the processor as shown by the dash-dotted line in FIG. 6B is the tray inserting slot 38 to receive the tray unit 34 in which the second and the third panels 36 and 37 are inserted into the first panel 35. Thus, damage to the tray unit 34 can be prevented during transportation or due to carelessness in using the processor. The reference numeral 51 shown in the drawing indicates an undercut which makes it easier for an operator to withdraw the tray unit 34 from the tray inserting slot 38.

FIG. 7A shows only a portion of another embodiment of the angle adjusting means of the tray unit of the present invention. An angle adjusting means 55 is provided which makes the tray unit 34 rotatable by forming shafts 39 on both sides 35S of the rear end 35B of the first panel 35 of the tray unit 34 and by forming shaft supporting holes 39A on the inner wall 9A of the tray inserting slot 38 on the lower main body 9 at a position which interlocks with the shaft 39. Also, holes 53 are formed at both of the sides 35S of the first panel 35, into which balls 56 are installed which are elastically supported by springs 54. A plurality of hemisphere recesses 58 are formed on the inner walls 9A of the lower main body 9 at a position corresponding to a track for rotation of the balls 56 so that the recesses 58 can selectively interlock with the balls 56 in the holes 53, when the tray unit 34 is rotated about the shaft 39. Therefore, the balls 56 which are elastically supported by the spring 54 selectively engage with the plurality of hemisphere recesses 58 so that the angle "$\theta$" of the tray unit 34 can be selectively adjusted. Here, the reference numeral 43 shown at the rear end 35B indicates a panel securing bracket which is installed when the second and the third panels 36 and 37 are inserted into the first panel 35.

FIG. 7B shows only a portion of the another embodiment of the angle adjusting means of the tray unit of the present invention. The following is a detailed explanation of the angle adjusting means 60. A cylindrical adjusting member 61 is formed on the rear end 35B of the first panel 35 of the tray unit 34. Shafts 39 are formed on the center of two sides 61S of the cylindrical adjusting member 61. Also, a plurality of angle adjusting protrusions 64 are formed radially at both of the sides 61S of the cylindrical adjusting member 61. A shaft supporting hole 39A is formed on the inner wall 9A of the lower main body 9 at a position which interlocks with the shaft 39 which is formed at the center of each side 61S of the cylindrical adjusting member 61. A plurality of friction protrusions 65 are also formed on the inner wall 9A radially having the shaft supporting holes 39A as their center in order to correspond to the plurality of angle adjusting protrusions 64. Therefore, the plurality of adjusting protrusions 64 and the plurality of friction protrusions 65 are selectively engaged upon movement of the tray unit 34 upwards and downwards. Thereby, the angle of the tray unit can be selectively adjusted. Here, the reference numeral 66 shown at the rear end 35B indicates the panel securing bracket which is installed when the second and the third panel 36 and 37 (not shown) are inserted into the first panel 35.

Figure 7C:
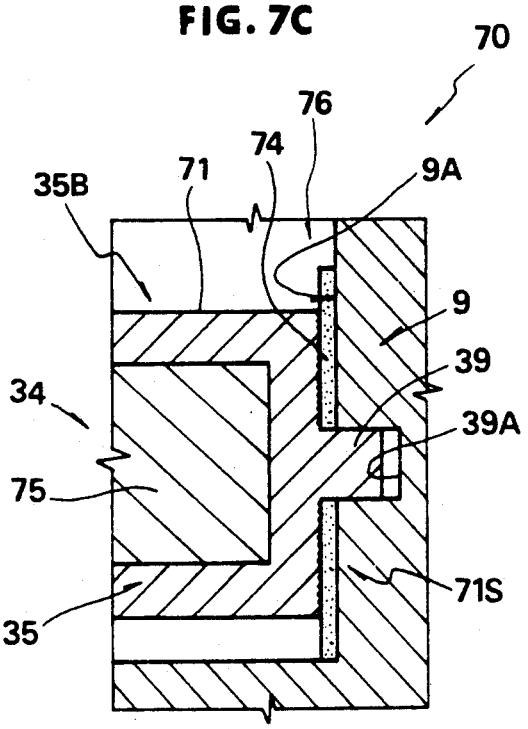

FIG. 7C shows a section view of only a portion of the first panel 35 which is yet another embodiment of the angle adjusting means of the tray unit of the present invention. The following is a detailed description of the angle adjusting means 70. A cylindrical adjusting member 71 is formed on the rear end 35B of the first panel 35 of the tray unit 34. A shaft 39 is formed on both of the sides 71S of the cylindrical adjusting member 71. Both of the sides 71S of the cylindrical adjusting member 71 are rough in form in order to have a high frictional coefficient. Also, a shaft supporting hole 39A is formed of the inner wall 9A of the lower main body 9 at a position which interlocks with the shaft 39. A serration plate 74 having a high frictional coefficient is installed as a frictional member 76 between both of the sides 71S of the cylindrical adjusting member 71 and the inner wall of the lower main body 9 which abuts both of the sides 71S, so that the angle of the tray unit 34 can be adjusted by the frictional force occurring therebetween. Here, the reference numeral 75 indicates the panel securing bracket which is installed when the second and the third panels 36 and 37 (not shown) are inserted into the first panel 35.

Figure 7D:
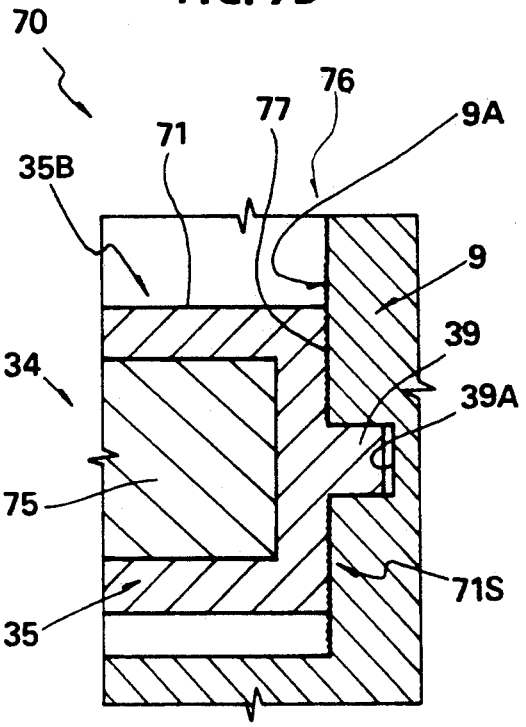

In FIG. 7D, a damping oil 77 of high frictional coefficient, instead of the serration plate 74, is injected, as a frictional member 76, between both of the sides 71S of the cylindrical adjusting member 71 and the inner wall 9A of the lower main body 9 which abuts both of the sides 71S in the construction of FIG. 7C. This injection of the damping oil 77 allows the angle of the tray unit to be adjusted by the frictional force occurring therebetween, as described above. Here, the reference numerals of the parts, which are the same as those in the construction of FIG. 7C, are omitted.

Figure 7E:
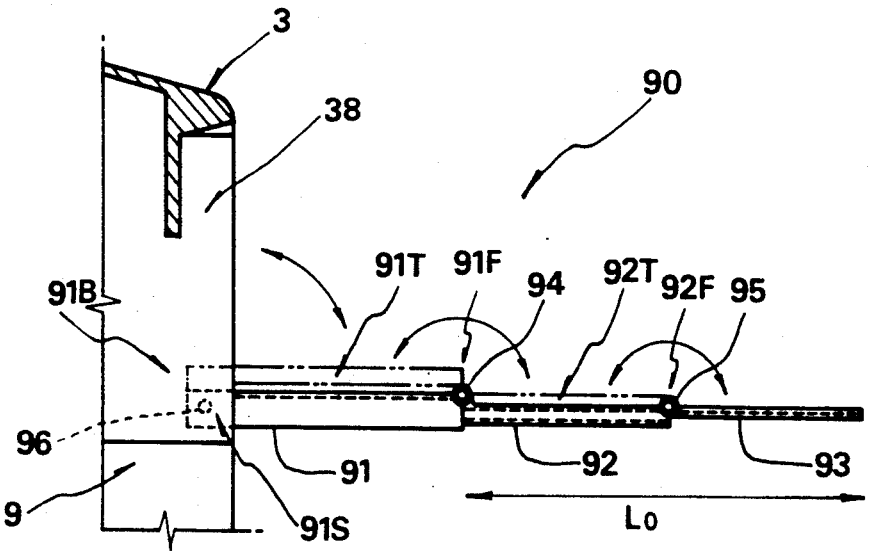

FIG. 7E shows another embodiment of the tray unit 34 of the present invention. The tray unit 90 of the embodiment is constructed so that the length Lo of the tray unit 90 can be adjusted by installing first and second hinges 94, 95 between a first, second and third panel 91, 92 and 93, instead of the construction in which the first, second and third panels 35, 36 and 37 are inserted and engaged by sliding, as shown in FIG. 5. That is, the third panel 93 is constructed so that it is folded into a top portion 92T of the second panel 92 by the second hinge 95 formed at a front end 92F of the second panel 92. The second panel 92, on which the third panel 93 is folded, is constructed so that it is folded into a top portion 91T of the first panel 91 by the first hinge 94 formed at the front end 91F of the first panel 91. As described above, the tray unit 90, which is constructed so that the first, second and third panels 91, 92 and 93 can be folded or extended, depending on the size of the discharged papers, can have its angle adjusted by utilizing the various angle adjusting means which are installed on the lower main body 9. Further, the tray unit 90 can be rotated about a shaft 96 formed at two sides 91S of a rear end 91B of the first panel 91. The tray unit 90 can also be inserted into the tray inserting slot 38 formed on one side of the processor when the processor is not used and the panels are folded.

As described above, according to the present invention, papers of a variety of sizes can be freely selected. At the same time, the installation area of the processor can be reduced because the multi-cassettes which receive the variety of sized papers can be loaded or replaced as being inclined downwards from the top cover. Further, the life time and the reliability of the processor are improved because the processor is constructed such that paper jamming can be easily remedied. Still further, according to the present invention, the angle and the length of the tray unit can be freely adjusted, depending on the size and the quantity of the discharged papers, so that the stack of papers can be discharged satisfactorily. Further, damage to the tray unit can be prevented when the processor is being transported or not being used for a long time.

Although this invention has been described in its preferred form with a certain degree of particularity, it is appreciated by those skilled in the art that the present disclosure of the preferred form has been made only by way of example and that numerous changes in the details of the construction, combination and arrangement of parts may be resorted to without departing from the spirit and scope of the invention.

What is claimed is:

1. An electronic photo processor having a lower main body provided with a tray inserting slot on one side of said lower main body, and a top cover which can be opened and closed elastically from and to said lower main body utilizing a tension rotating apparatus on the other side of said lower main body, wherein said processor comprises:

a slide-type opening and closing apparatus for opening and closing said top cover from and to said lower main body, said apparatus including a fixing bracket, a lock shaft and a slide-type opening and closing knob which is self-supported elastically by a spring SP, with each of said fixing bracket, lock shaft and slide-type opening and closing knob being installed at said top cover, respectively, said apparatus further including a double locker arm elastically rotatably engaged to said lock shaft by a tension spring formed on a shaft, and elastically supported by said fixing bracket, with said double locker arm being installed at said lower main body, such that, in use, said arm can be disengaged from said lock shaft by slidably pulling said slide-type opening and closing knob to make said top cover open;

a paper supplying apparatus for selectively supplying a plurality of papers having a variety of sizes and for enabling said papers to be supplied as being inclined downwards from said top cover, said paper supplying apparatus comprising multi-cassettes for selectively containing said papers, each of said multi-cassettes having openings to selectively discharge said papers contained therein, cassette receiving slots formed to be inclined downwards on said top cover for loading said multi-cassettes inclined downwards, pick-up rollers installed in close contact with said openings of said multi-cassettes so as to extract said papers, and frictional plates for producing the frictional forces for extracting said papers, said frictional plates being operatively installed in close contact with said pick-up rollers;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body, said fixing apparatus further comprising a housing including a receiving opening for receiving said papers developed by said developing means, an upper end positioned at the side of said receiving opening and a lower end positioned at the opposite side of said receiving opening, a heating roller and a pressurizing roller formed in said housing for heat-treatment of said papers transferred through said receiving opening, a second guide for guiding said papers through said heat-treatment in said heating roller and said pressurizing roller, a first cover rotatably installed by a first hinge at said upper end of said receiving opening of said housing, a second cover rotatably installed by a second hinge at said first cover and having a handle at its one end, and a third cover rotatably installed by a third hinge at said lower end positioned at the opposite side to said receiving opening of said housing, said third cover having a discharging opening for discharging said papers, a pair of paper discharging rollers for discharging said papers toward said discharging opening, and a connecting piece which detachably connects with said handle of said second cover, whereby said fixing apparatus can be completely or partially either opened or closed by disengaging or engaging said handle of said second cover from or with said connecting piece of said third cover; and a paper discharging means removably installed adjacent said tray inserting slot of said lower main body and having a tray unit means the length of which can be adjusted depending upon the size of said papers discharged and an angle adjusting means which is provided at said tray inserting slot of said lower main body having an inner wall so as to adjust the angle of said tray unit means, wherein said tray unit means further includes a tray unit comprising:

a first hollow panel having two sides, two inner sides, a rear end, a front end and a top portion, said first panel further including a pair of stops formed at both of said inner sides of said front end, a pair of shafts formed at both of said sides of said rear end and a drawing hole formed in the middle of said top portion, a second hollow panel having two sides, two inner sides, a rear end and a front end, said second panel further including a pair of stops formed at both of said inner sides of said front end and protrusions formed at both of said sides of a rear end so as to interact with said stops of said first panel, a third panel having two sides and a rear end, said third panel further including protrusions formed at both of said sides of said rear end so as to interact with said stops of said second panel, to thereby slide said second and third panel into said first and second panel through said rear end of said first and second panel, respectively, and a panel securing bracket provided at said rear end of said first panel to prevent said second and third panel, inserted into said first panel, from escaping therefrom, wherein said angle adjusting means further includes an angle adjusting apparatus comprising:

a pair of shaft supporting holes formed at said inner wall of said tray inserting slot of said lower main body to rotatably support a pair of said shafts formed at both of said sides of said rear end of said first panel, a pair of arcuate brackets formed at both of said sides of said rear end of said first panel of said tray unit, each of said arcuate brackets having concavo-convex ends, respectively, and a pair of band springs installed on said lower main body utilizing a plurality of bolts, each of said band springs having concavo-convex portions which elastically interlock with said concavo-convex ends to thereby adjust the angle of said tray unit.

2. The electronic photo processor, as claimed in claim 1, wherein the inside and outside surfaces of said first, second and third panels are constructed to have longitudinal concavo-convex configuration to minimize the frictional force between said panels at the time of the sliding extension and retracting operation of said second and third panels and also to minimize the frictional force between said papers discharged and said first, second and third panel.

3. An electronic photo processor having a lower main body and a top cover, wherein said processor comprises:

a paper supplying apparatus for selectively supplying a plurality of papers having a variety of sizes;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body for performing heat treatment of said papers developed by said developing means;

a tray inserting slot 38 formed in one side of said lower main body;

a paper discharging means installed adjacent said tray inserting slot of said lower main body and having a tray unit means for supporting paper discharged from said paper discharging means and wherein said tray unit means further includes a tray unit comprising:

a first panel 35 having two sides, a rear end, a front end, a top portion and a pair of shaft formed at both of said sides of said rear end of said first panel;

an angle adjusting means for adjusting the angle that said tray unit receives discharged paper provided at said tray inserting slot of said lower main body with said lower main body 9 further including an inner wall 9A with said angle adjusting means further including an angle adjusting apparatus comprising:

a pair of shaft supporting holes formed in said inner wall of said lower main body to rotatably support said pair of shafts formed at both of side of said rear end of said first panel at said tray inserting slot, respectively;

a pair of arcuate brackets formed at both of said sides of said rear end of said first panel of said tray unit, each of said arcuate brackets having concavo-convex ends, respectively; and a pair of band springs installed on said lower main body with each of said band springs having concavo-convex portions which elastically interlock with said concavo-convex ends of said arcuate brackets, respectively, to enable adjustment of the angle to said tray unit.

4. The electronic photo processor of claim 3 wherein said first panel is hollow and further includes two inner sides and a pair of stops formed at both of said inner sides of said front end;

said tray unit further includes a second hollow panel having two sides, two inner sides, a rear end and a front end and further including a pair of stops formed at both of said inner sides of said front end and protrusions formed at both of said sides of a rear end so as to interact with said stops of said first panel;

a third panel having two sides and a rear end and further including protrusions formed at both of said sides of said rear end so as to interact with said stops of said second panel such that in use said third panel slides into said second hollow panel and said second hollow panel slides into said first hollow panel, respectively; and a panel securing bracket provided at said rear end of said first panel to prevent said second and said third panels from sliding into said housing.

5. The electronic photo processor, as claimed in claim 4, wherein the inside and outside surfaces of said first, second, and third panels are constructed to have longitudinal concavo-convex configuration to minimize the frictional force between said panels at the time of the sliding extension and retraction operation of said second and third panels and also to minimize the frictional force between said papers discharged and said first, second and third panel.

6. An electronic photo processor having a lower main body and a top cover, wherein said processor comprises:

a paper supplying apparatus for selectively supplying a plurality of papers having a variety of sizes;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body for performing heat treatment of said papers developed by said developing means;

a tray inserting slot 38 formed in one side of said lower main body;

a paper discharging means installed adjacent said tray inserting slot of said lower main body and having a tray unit means for supporting paper discharged from said paper discharging means and wherein said tray unit means further includes a tray unit comprising:

a first panel 35 having two sides, a rear end, a front end, a top portion and a pair of shaft formed at both of said sides of said rear end of said first panel;

an angle adjusting means for adjusting the angle that said tray unit receives discharged paper provided at said tray inserting slot of said lower main body with said lower main body 9 further including an inner wall 9A with said angle adjusting means further including an angle adjusting apparatus comprising:

a pair of shaft supporting holes formed in said inner wall of said lower main body to rotatably support said pair of shafts formed at both of sides of said rear end of said first panel when positioned at said tray inserting slot, respectively;

a pair of holes formed at both of said sides of said rear end of said first panel of said tray unit, with each of said holes having a spring contained therein and a ball elastically supported by said springs; and a plurality of hemisphere recesses formed in said inner wall of said lower main body at a position corresponding to a track for rotation of said balls at the time of rotation of said tray unit about said shafts, such that, in use, said ball which is elastically supported by said springs contained in said hole is frictionally interlocked with said plurality of hemisphere recesses to thereby adjust the angle of said tray unit.

7. The electronic photo processor of claim 6 wherein said first panel is hollow and further includes two inner sides and a pair of stops formed at both of said inner sides of said front end;

said tray unit further includes a second hollow panel having two sides, two inner sides, a rear end and a front end and further including a pair of stops formed at both of said inner sides of said front end and protrusions formed at both of said sides of a rear end so as to interact with said stops of said first panel;

a third panel having two sides and a rear end and further including protrusions formed at both of said sides of said rear end so as to interact with said stops of said second panel such that in use said third panel slides into said second hollow panel and said second hollow panel slides into said first hollow panel, respectively; and a panel securing bracket provided at said rear end of said first panel to prevent said second and said third panels from sliding into said housing.

8. The electronic photo processor claim 6, wherein the inside and outside surfaces of said first, second and third panels are constructed to have longitudinal concavo-convex configuration to minimize the frictional force between said panels at the time of the sliding extension and retraction operation of said second and third panels and also to minimize the frictional force between said papers discharged and said first, second and third panel.

9. An electronic photo processor having a lower main body and a top cover, wherein said processor comprises:

a paper supplying apparatus for selectively supplying a plurality of papers having a variety of sizes;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body for performing heat treatment of said papers developed by said developing means;

a tray inserting slot 38 formed in one side of said lower main body;

a paper discharging means installed adjacent said tray inserting slot of said lower main body and having a tray unit means for supporting paper discharged from said paper discharging means and wherein said tray unit means further includes a tray unit comprising:

a first panel 35 having two sides, a rear end, a front end, a top portion and a pair of shaft formed at both of said sides of said rear end of said first panel;

an angle adjusting means for adjusting the angle that said tray unit receives discharged paper provided at said tray inserting slot of said lower main body with said lower main body 9 further including an inner wall 9A with said angle adjusting means further including an angle adjusting apparatus comprising:

a pair of shaft supporting holes formed in said inner wall of said lower main body to rotatably support said pair of shaft formed at both of side of said rear end of said first panel when positioned at said tray inserting slot, respectively;

a cylindrical adjusting member formed at said rear end of said first panel of said tray unit, said cylindrical adjusting member having two sides the center of each formed with said shafts;

a plurality of angle adjusting protrusions radially formed on both of said sides having said shaft; and a plurality of friction protrusions formed radially on said inner wall of said lower main body at a position corresponding to said plurality of angle adjusting protrusions, such that, in use, said plurality of angle adjusting protrusions is frictionally interlocked with said plurality of friction protrusions to thereby adjust the angle of said tray unit.

10. The electronic photo processor of claim 8 wherein said first panel is hollow an further includes two inner sides and a pair of stops formed at both of said inner sides of said front end;

said tray unit further includes a second hollow panel having two sides, two inner sides, a rear end and a front end and further including a pair of stops formed at both of said inner sides of said front end and protrusions formed at both of said sides of a rear end so as to interact with said stops of said first panel;

a third panel having two sides and a rear end and further including protrusions formed at both of said sides of said rear end so as to interact with said stops of said second panel such that in use said third panel slides into said second hollow panel and said second hollow panel slides into said first hollow panel, respectively; and a panel securing bracket provided at said rear end of said first panel to prevent said second and said third panels from sliding into said housing.

11. The electronic photo processor of claim 10, wherein the inside and outside surfaces of said first, second and third panels are constructed to have longitudinal concavo-convex configuration to minimize the frictional force between said panels at the time of the sliding extension and retraction operation of said second and third panels and also to minimize the frictional force between said papers discharged and said first, second and third panel.

12. An electronic photo processor having a lower main body and a top cover, wherein said processor comprises:

a paper supplying apparatus for selectively supplying a plurality of papers having a variety of sizes;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body for performing heat treatment of said papers developed by said developing means;

a tray inserting slot 38 formed in one side of said lower main body;

a paper discharging means installed adjacent said tray inserting slot of said lower main body and having a tray unit means for supporting paper discharged from said paper discharging means and wherein said tray unit means further includes a tray unit comprising:

a first panel 35 having two sides, a rear end, a front end, a top portion and a pair of shaft formed at both of said sides of said rear end of said first panel;

an angle adjusting means for adjusting the angle that said tray unit receives discharged paper provided at said tray inserting slot of said lower main body with said lower main body 9 further including an inner wall 9A with said angle adjusting means further including an angle adjusting apparatus comprising:

a pair of shaft supporting holes formed in said inner wall of said lower main body to rotatably support said pair of shaft formed at both of side of said rear end of said first panel when positioned at said tray inserting slot, respectively;

a cylindrical adjusting member formed on said rear end of said first panel of said tray unit with said cylindrical adjusting member having two sides the center of a high frictional coefficient, the center of each formed with said shafts; and a frictional member of a high frictional coefficient inserted between both of said sides and said inner wall of said tray inserting slot of said lower main body, such that in use, the angle of said tray unit can be adjusted by producing a frictional force between both of said sides of said cylindrical adjusting member and said frictional member.

13. The electronic photo processor of claim 12 wherein said first panel is hollow and further includes two inner sides and a pair of stops formed at both of said inner sides of said front end;

said tray unit further includes a second hollow panel having two sides, two inner sides, a rear wend and a front end and further including a pair of stops formed at both of said inner sides of said front end and protrusions formed at both of said sides of a rear end so as to interact with said stops of said first panel;

a third panel having two sides and a rear end and further including protrusions formed at both of said sides of said rear end so as to interact with said stops of said second panel such that in use said third panel slides into said second hollow panel and said second hollow panel slides into said first hollow panel, respectively; and a panel securing bracket provided at said rear end of said first panel to prevent said second and said third panels from sliding into said housing.

14. The electronic photo processor of claim 13, wherein the inside and outside surfaces of said first, second and third panels are constructed to have longitudinal concavo-convex configuration to minimize the frictional force between said panels at the time of the sliding extension and retraction operation of said second and third panels and also to minimize the frictional force between said papers discharged and said first, second and third panel.

15. The electronic photo processor of claim 12, wherein said frictional member is a serration plate.

16. The electronic photo processor of claim 12, wherein said frictional member is a damping oil.

17. The electronic photo processor having a lower main body and a top cover, wherein said processor comprises:

a paper supplying apparatus for selectively supplying a plurality of papers having a variety of sizes;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body for performing heat treatment of said papers developed by said developing means;

a tray inserting slot 38 formed in one side of said lower main body;

a paper discharging means installed adjacent said tray inserting slot of said lower main body and having a tray unit means for supporting paper discharged from said paper discharging means and wherein said tray unit means further includes a tray unit comprising:

a first hollow panel 35 having two sides, two inner sides, a rear end, a front end and a top portion and further including a pair of stops formed at both of said inner sides of said front end and a pair of shafts formed at both of said sides of said rear end;

a second hollow panel having two sides, two inner sides, a rear end and a front end and further including a pair of stops formed at both of said inner sides of said front end and protrusions formed at both of said sides of a rear end so as to interact with said stops of said first panel;

a third panel having two sides and a rear end and further including protrusions formed at both of said sides of said rear end so as to interact with said stops of said second panel such that in use said third panel slides into said second hollow panel and said second hollow panel slides into said first hollow panel, respectively;

a panel securing bracket provided at said rear end of said first panel to prevent said second and said third panels from sliding into said housing;

an angle adjusting means for adjusting the angle of said tray unit means provided at said tray inserting slot of said lower main body with said lower main body 9 further including an inner wall 9A with said angle adjusting means further including an angle adjusting apparatus comprising:

a pair of shaft supporting holes formed in said inner wall of said lower main body to rotatably support said pair of shafts formed at both of sides of said rear end of said first panel at said tray inserting slot, respectively;

a pair of arcuate brackets formed at both of said sides of said rear end of said first panel to said tray unit, each of said arcuate brackets having concavo-convex ends, respectively; and a pair of band springs installed on said lower main body with each of said band springs having concavo-convex portions which elastically interlock with said concavo-convex ends of said arcuate brackets, respectively to enable adjustment of the angle of said tray unit.

18. The electronic photo processor claim 17, wherein the inside and outside surface of said first, second and third panels are constructed to have longitudinal concavo-convex configuration to minimize the frictional force between said panels at the time of the sliding extension and retraction operation of said second and third panels and also to minimize the frictional force between said papers discharged and said first, second and third panel.

19. An electronic photo processor having a lower main body and a top cover, wherein said processor comprises:

a paper supplying apparatus for selectively supplying a plurality of papers having a variety of sizes;

a paper transferring apparatus formed on said lower main body, said paper transferring apparatus being provided with a first guide for guiding papers selectively supplied from said paper supplying apparatus, a pair of transferring rollers arranged to be spaced horizontally relative to each other for transferring said papers guided on said first guide, and a pair of register rollers arranged vertically in close contact relative to each other;

an optical apparatus provided with a scanning unit for scanning a laser beam by converting an electrical signal to said laser beam and a reflecting mirror for reflecting said laser beam;

a developing means for developing said papers transferred from said paper transferring apparatus with said laser beam transmitted from said optical apparatus;

a fixing apparatus formed on said lower main body for performing heat treatment of said papers developed by said developing means;

a tray inserting slot 38 formed in one side of said lower main body;

a paper discharging means installed adjacent said tray inserting slot of said lower main body and having a tray unit means for supporting paper discharged from said paper discharging means and wherein said tray unit means further includes a tray unit comprising:

a first panel 91 having two sides, a rear end, a front end and a top portion, said first panel further including a pair of shafts formed on both of said sides of said rear end;

a second panel 92 having a front end and a top portion, with said second panel being installed to be folded to said top portion of said first panel by utilizing a first hinge formed at said front end of said first panel; and a third panel 93 installed to be folded to said top portion of said second panel utilizing a second hinge formed at said front end of said second panel, such that, in use, said first, said second and third panels can be selectively unfolded to extend said tray unit 90 to received correspondingly sized paper or to fold-up said tray unit such that said tray unit can be completely received into said tray inserting slot 30 for storage; and an angle adjusting means for adjusting the angle that said tray unit receives discharged paper provided at said tray inserting slot of said lower main body.

* * * * *